US006877719B2

(12) United States Patent
Heinl

(10) Patent No.: US 6,877,719 B2
(45) Date of Patent: Apr. 12, 2005

(54) VALVE SHAFT SEAL

(75) Inventor: Werner Heinl, Burscheid (DE)

(73) Assignee: AB SKF, Gothenburg (SE)

( * ) Notice: Subject to any disclaimer, the term of this patent is extended or adjusted under 35 U.S.C. 154(b) by 155 days.

(21) Appl. No.: 10/272,913

(22) Filed: Oct. 18, 2002

(65) Prior Publication Data

US 2003/0085374 A1 May 8, 2003

(30) Foreign Application Priority Data

Oct. 18, 2001 (DE) ..... 101 51 606

(51) Int. Cl.[7] ..... F01L 3/08
(52) U.S. Cl. ..... 251/337; 277/502; 123/190.17
(58) Field of Search ..... 251/337; 277/502; 123/188.2, 188.3, 188.4, 188.6, 190.17

(56) References Cited

U.S. PATENT DOCUMENTS 1,218,730 A * 3/1917 Wettrich et al. ..... 251/337
4,317,436 A 3/1982 Barnhart et al.
5,174,256 A * 12/1992 Binford ..... 123/188.6
6,244,235 B1 6/2001 Hegemier et al.

FOREIGN PATENT DOCUMENTS

| | | | | |
|---|---|---|---|---|
| DE | 3902518 | * | 1/1989 | ..... F01L/3/08 |
| EP | 0 392 893 A | | 10/1990 | |
| EP | 0 645 524 A | | 3/1995 | |
| JP | 2004-176881 | * | 6/2004 | ..... F16J/15/62 |

* cited by examiner

*Primary Examiner*—J. Casimer Jacyna
(74) *Attorney, Agent, or Firm*—Burns, Doane, Swecker & Mathis, L.L.P.

(57) ABSTRACT

A valve shaft seal includes a reinforcing ring having a cylindrical section extending over a certain axial length and possessing an outer diameter, a sealing element disposed on the reinforcing ring, and a valve spring supported on a radially extending end section of the reinforcing ring. To support the valve spring on the radially extending end section of the reinforcing ring, the radially extending end section extends radially farther inward in the direction of the axis of the valve shaft seal than the outer diameter of the cylindrical section of the reinforcing ring.

19 Claims, 5 Drawing Sheets

VALVE SHAFT SEAL

This application is based on and claims priority under 35 U.S.C. § 119 with respect to German Application No. 101 51 606.1 filed on Oct. 18, 2001, the entire content of which is incorporated herein by reference.

FIELD OF THE INVENTION

The invention generally relates to a valve shaft seal. More particularly, the invention pertains to a valve shaft seal having a reinforcing ring possessing a cylindrical section extending over a certain axial length, with the cylindrical section having an outer diameter, a sealing element disposed on the reinforcing ring, and a valve spring supported on a radially extending end section of the reinforcing ring.

BACKGROUND OF THE INVENTION

A general construction of a valve shaft seal is disclosed in German Offenlegungsschrift No. DE 39 02 518 A1. The disclosed valve shaft seal is constructed with a reinforcing ring having a radially extending end section, with the reinforcing ring being supported on the component which carries the valve shaft seal. The disclosed valve shaft seal is also provided with a valve spring. To support the valve spring, a spiral spring is ground off at one end so that it presents a good resting surface on the radially extending end section of the reinforcing ring. The radially extending end section changes with a radius into the cylindrical section extending over a certain length of the reinforcing ring which forms a centering mechanism for the valve spring.

However, it has been found that problems can arise with this construction in that the sharply ground end of the valve spring in the radius area that is in the transitional area between the radially extending end section of the reinforcing ring and the cylindrical section of the reinforcing ring can press in and possibly damage the surface of the reinforcing ring. This can in turn lead to the formation of cracks in the reinforcing ring or break-offs from the reinforcing ring. As a result, damage of the valve shaft seal can occur which may lead to premature failure of the seal.

A need thus exists for a valve shaft seal of the type mentioned above which provides a reliable support of the valve spring on the radially extending end section of the reinforcing ring and a clean centering of the valve spring by the cylindrical section of the reinforcing ring, but which nevertheless reduces the likelihood that the valve spring sharply ground in the end area will cause damage to the reinforcing ring.

SUMMARY OF THE INVENTION

According to one aspect, a valve shaft seal includes a reinforcing ring which includes a cylindrical section extending over an axial length and a radially extending end section, a sealing element disposed on the reinforcing ring, and a valve spring supported on the radially extending end section of the reinforcing ring. The radially extending end section extends farther radially inward toward the axis of the valve shaft seal than the outer diameter of the cylindrical section of the reinforcing ring.

The valve shaft seal is thus designed with a certain back-cutting of the cylindrical section of the reinforcing ring in the area of the radially extending end section of the reinforcing ring. The relatively sharply ground valve spring is thus supported cleanly on the end area of the reinforcing ring without causing damage to the base or radially extending end section of the reinforcing ring.

The transition from the radially extending end section of the reinforcing ring to the rest of the reinforcing ring is preferably formed by a transition section provided with a radius. This transition section is preferably provided with a radius having its midpoint located essentially on the outer diameter of the cylindrical section.

To improve the centering of the valve spring, the outer diameter of the cylindrical section of the reinforcing ring is preferably formed by a number of protuberances distributed over the circumference of the cylindrical section. Alternatively, a number of centering elements for the valve springs can be disposed radially outwards on the cylindrical section of the reinforcing ring, with the centering elements being positioned over the circumference of the reinforcing ring. The centering elements can be formed by placing, in particular shrinking, an additional annular part on the cylindrical section of the reinforcing ring.

With this construction of the valve shaft seal, particularly the reinforcing ring, the operating life of the valve shaft seal improved. At the same time, a satisfactory functioning operation is achieved by virtue of the good centering of the valve spring by the cylindrical section of the reinforcing ring and its optimal support on the radially extending end section of the reinforcing ring.

According to another aspect, a valve shaft seal is mounted on a rod and includes a reinforcing ring comprising a radially outwardly directed end section extending away from the rod, a cylindrical section, and a transition section between the cylindrical section and the radially outwardly directed end section. A sealing element which contacts the rod is disposed on an end section of the reinforcing ring that is opposite the radially outwardly directed end section. A valve spring provided with a planar end is supported on the radially outwardly directed end section of the reinforcing ring. The transition section between the cylindrical section and the radially outwardly directed end section of the reinforcing ring is located relative to the cylindrical section such that the outer surface of the transition section is located closer to the axis of the valve shaft seal than the outer surface of the cylindrical section.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
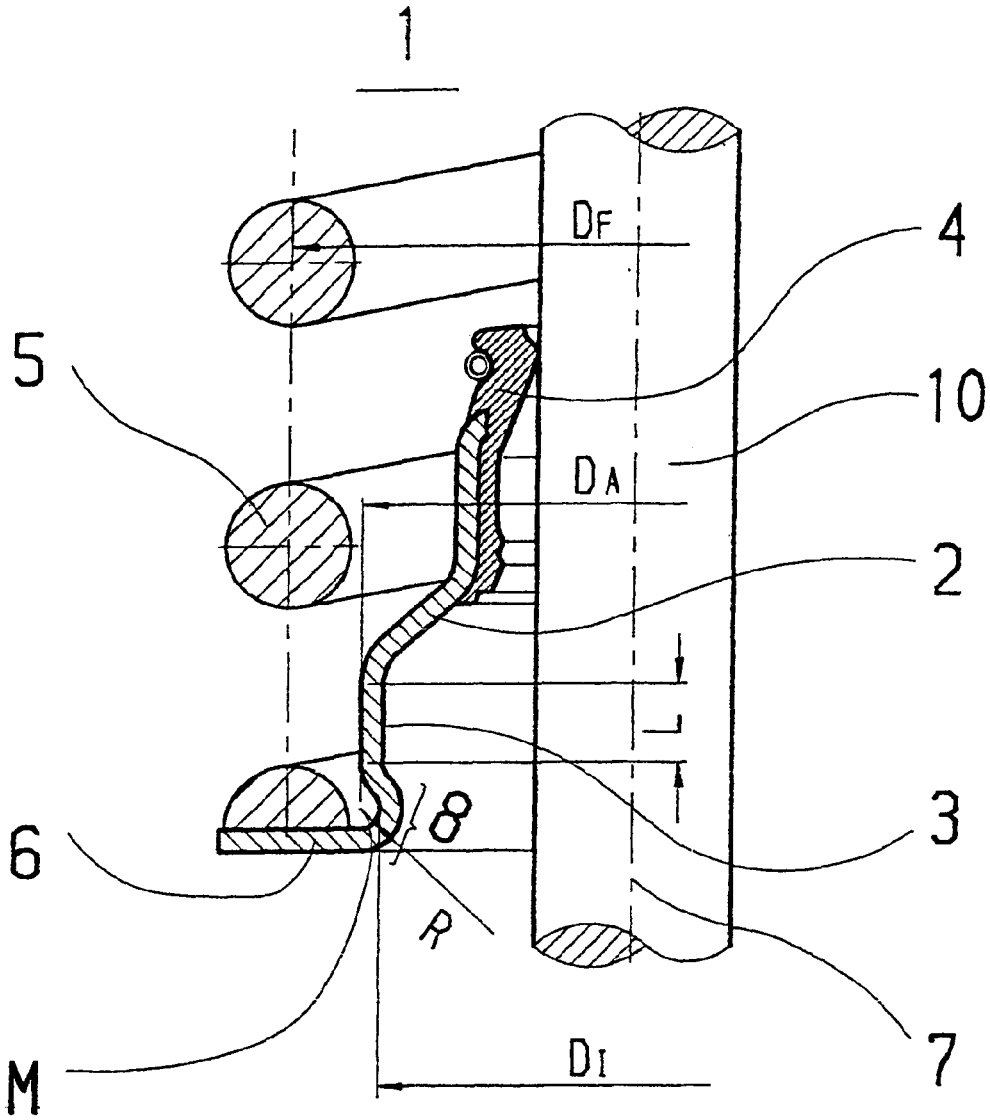
FIG. 1 is a side view, partly in cross-section, of a valve shaft seal including a portion of the valve spring.

The valve shaft seal 1 represented in FIG. 1 serves primarily for sealing a rod-like section of another machine part. For this reason, a reinforcing ring 2 is provided and has a radially extending end section 6. The reinforcing ring is preferably made of metal. An elastomeric sealing material is vulcanized on the reinforcing ring 2 to form a sealing element 4. The sealing element 4 frictionally engages the rod 10 and thus seals the rod 10.

A valve spring 5 is also provided for preloading the valve with which the rod 10 is associated. To center the valve spring 5 relative to the valve shaft seal 1, the reinforcing ring 2 has a cylindrical section 3 which extends over a certain axial length L. This cylindrical section 3 has an outer diameter $D_A$. This outer diameter $D_A$ is selected to provide a desired or optimal centering of the valve spring 5 having an average diameter $D_F$.

The valve spring 5 is supported at its lower area or lower end on the radially extending end section 6 of the reinforcing ring 2. As can be seen, the lower end or lower area of the valve spring 5 is ground off so that a relatively clean and planar support on the end section 6 results for the last winding of the valve spring 5. However, grinding off or otherwise forming the lower end of the valve spring 5 to form the planar support can have the potential consequence that the resulting sharp edges at the end section of the valve spring 5 can press with a relatively high surface pressure on the radially extending end section 6 of the reinforcing ring 2. To the extent preventive measures are not taken, this can cause damage to the radially extending end section 6 of the reinforcing ring 2.

To inhibit or avoid this, the radially outwardly extending end section 6 of the reinforcing ring 2 is configured to extend farther inwardly, in the direction toward the axis 7 of the valve shaft seal 1, than the outer diameter $D_A$ of the cylindrical section 3 of the reinforcing ring 2. Thus, the transition section 8 between the cylindrical section 3 and the radially outwardly extending section 6 has an outer surface located closer to the axis 7 of the valve shaft seal 1 than the outer surface of the cylindrical section 3. In addition, the transition area between the end section 6 of the reinforcing ring 2 and the cylindrical section 3 of the reinforcing ring 2 approaches the axis 7 up to a diameter $D_I$. This outer diameter $D_I$ of the reinforcing ring 2 is therefore smaller at its radially inner point than the outer diameter $D_A$ of the cylindrical section 3.

This construction helps provide, upon centering the valve spring 5 by the cylindrical section 3 of the reinforcing ring 2, a planar surface over the full circumference for the support of the end section of the valve spring 5 on the radially extending end section 6.

To further assist in achieving this result, the transitional radius from the radially extending end section 6 to the cylindrical section 3 is made by a radius R whose midpoint M (center of curvature) lies on the circumference of an imaginary cylinder defined by the outer diameter $D_A$. The transition section 8 between the radially extending end section 6 and the cylindrical section 3 is formed by this radius R.

Figure 2:
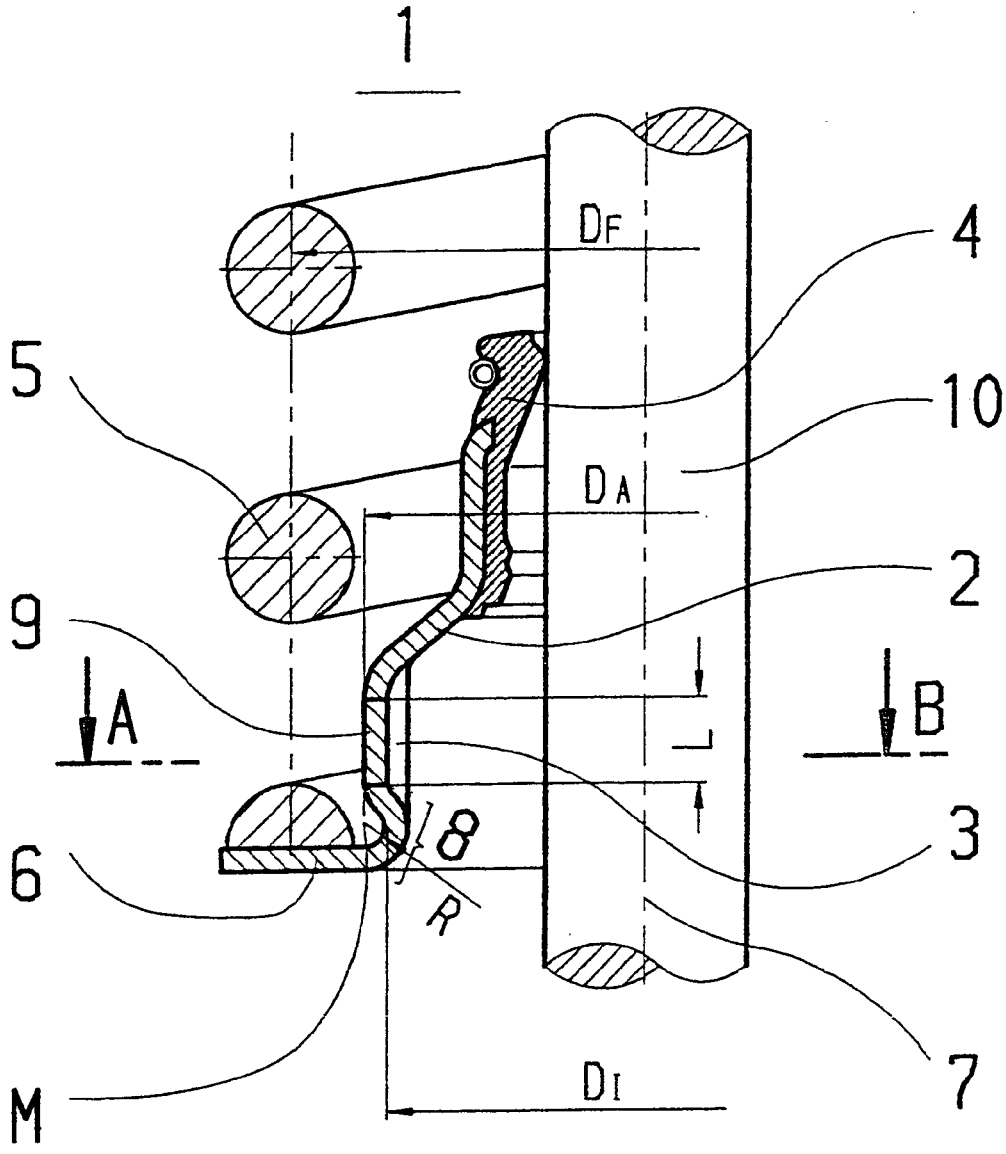
FIG. 2 is a side view similar to FIG. 1 illustrating a variation on the valve shaft seal illustrated in FIG. 1.
Figure 3:
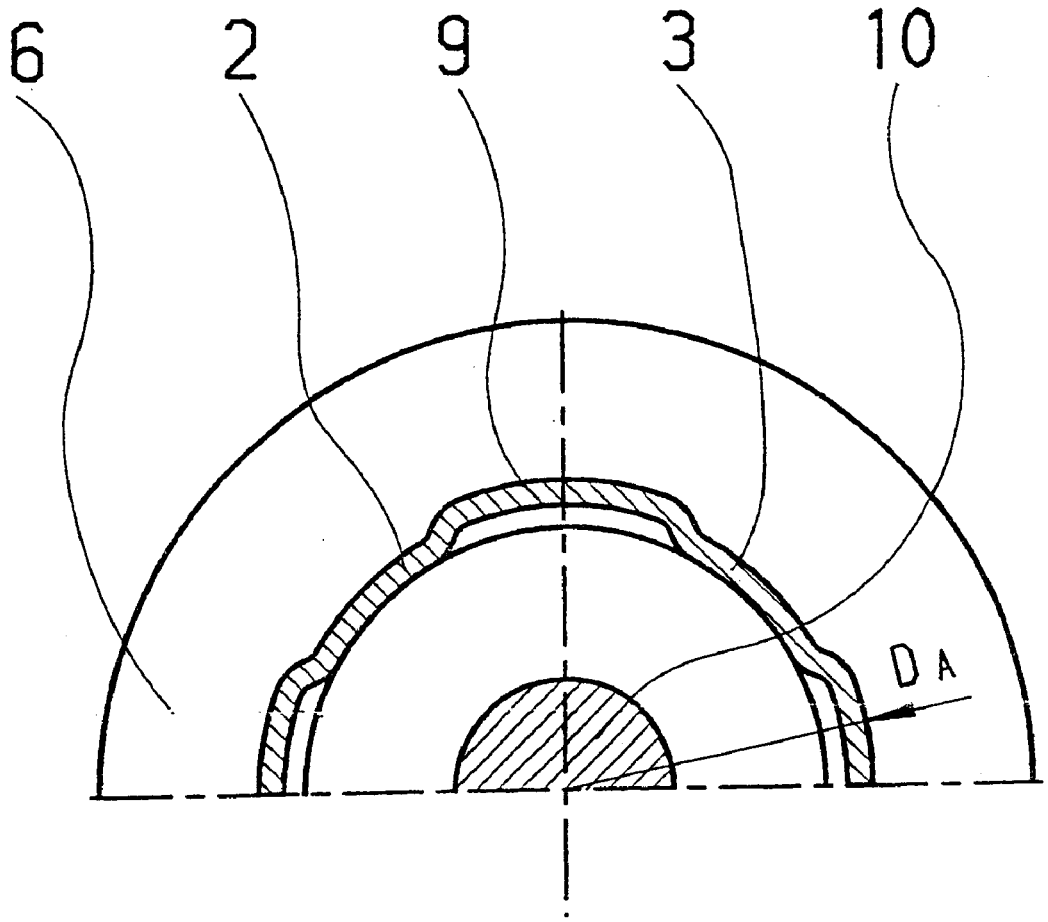
FIG. 3 is a cross-sectional view of the valve shaft seal shown in FIG. 2 taken along the section line III—III in FIG. 2.

As can be seen in FIGS. 2 and 3, to improve the centering of the valve spring 5 on the cylindrical section 3, the cylindrical section 3 is provided with centering elements 9 in the form of protuberances which are circumferentially distributed over the cylindrical section 3 of the reinforcing ring 2. These protuberances 9 are therefore formed by the reinforcing ring 2 itself. From the standpoint of production technology, the production of the protuberances 9 can be accomplished in a particularly simple and thus cost-effective manner. As can furthermore be seen, the centering diameter is formed primarily by the outer circumference $D_A$ of the centering elements 9.

Figure 4:
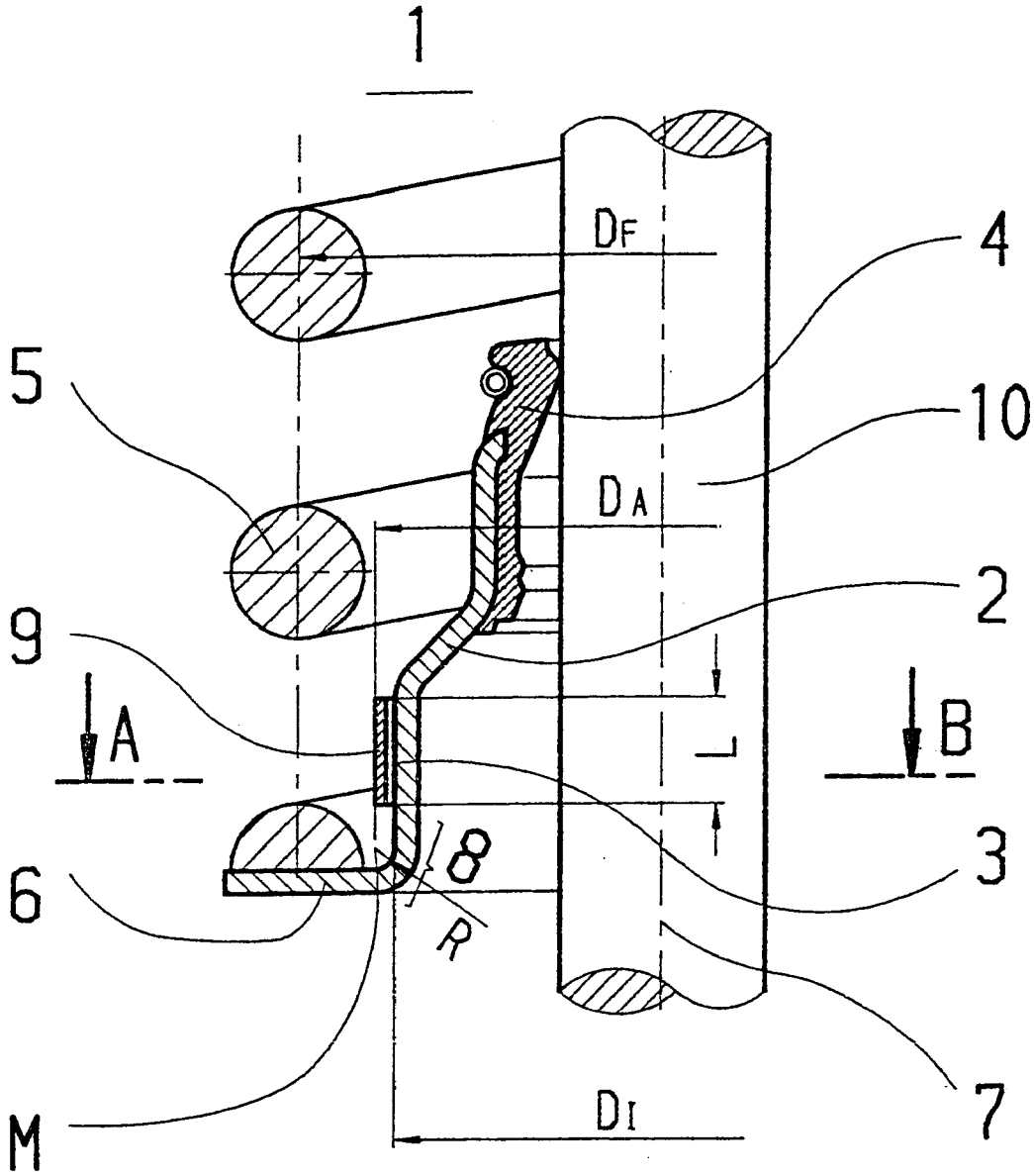
FIG. 4 is a side view of the valve shaft seal according to an additional alternative embodiment.
Figure 5:
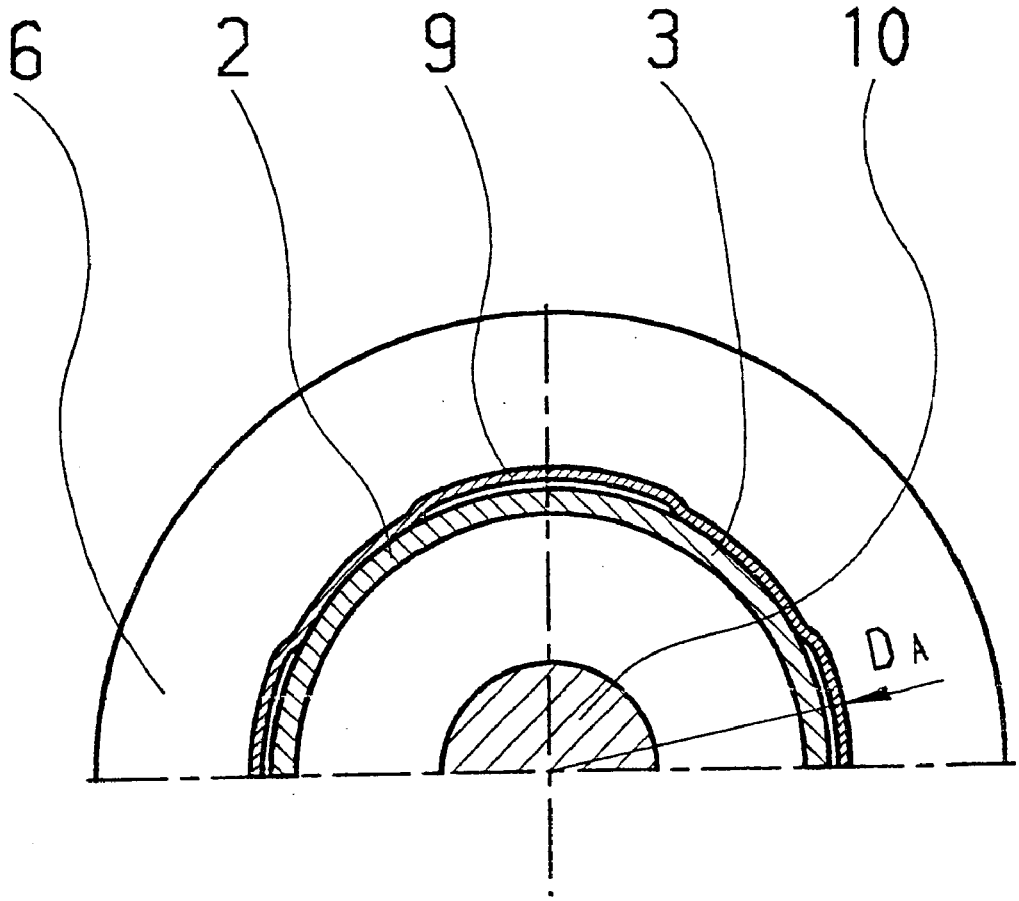
FIG. 5 is a cross-sectional view of the valve shaft seal shown in FIG. 4 taken along the section line V—V in FIG. 4.

With particular reference to FIG. 3, it can be seen how the reinforcing ring 2 is formed in the area of the cylindrical section 3 in order to form the centering elements 9. However, the centering elements can be provided in a different form such as shown in FIGS. 4 and 5. Here, the reinforcing ring 2 includes an annular member that is shrunk or otherwise provided on the cylindrical section 3 to provide the centering elements 9 which, as explained, form the centering surface for the valve spring 5. In this alternative embodiment, the annular member is provided with the protuberances constituting the centering elements 9. As in the embodiments described above, the outer diameter $D_A$ of the reinforcing ring 2 in the area of the cylindrical section 3 is greater than the diameter $D_I$ of the transition section 8 between the radially outwardly extending section 6 and the cylindrical section 3. However, in the version shown in FIGS. 4 and 5, the cylindrical section 3 of the reinforcing ring 2 need not be back-cut to form the transition section 8 as in the case of the embodiments shown in FIGS. 1–3 because of the way in which the cylindrical section 3 is formed. Of course, it is to be understood that in the embodiment shown in FIGS. 4 and 5, the cylindrical section 3 of the reinforcing ring 2 can also be back-cut in a manner similar to that shown in FIGS. 1–3. Thus, the arrangement shown in FIGS. 1–3 for providing the relationship $D_A>D_I$ can be combined with the arrangement shown in FIGS. 4 and 5 for providing the relationship $D_A>D_I$.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve shaft seal having an axis comprising:

a reinforcing ring which includes a cylindrical section extending over an axial length and a radially extending end section, the cylindrical section possessing an outer diameter;

a sealing element disposed on the reinforcing ring;

a valve spring supported on the radially extending end section of the reinforcing ring; and the radially extending end section extending farther radially inward toward the axis of the valve shaft seal than the outer diameter of the cylindrical section of the reinforcing ring.

2. The valve shaft seal according to claim 1, wherein a transition from the radially extending end part of the reinforcing ring to the cylindrical section of the reinforcing ring is formed by a transition section of the reinforcing ring which possesses a radius.

3. The valve shaft seal according to claim 2, wherein the radius of the transition section has a midpoint located on the outer diameter of the cylindrical section.

4. The valve shaft seal according to claim 3, wherein the outer diameter of the cylindrical section is formed with a plurality of spaced apart protuberances distributed over a circumference of the cylindrical section.

5. The valve shaft seal according to claim 4, wherein the reinforcing ring is made of metal.

6. The valve shaft seal according to claim 3, including a plurality of centering elements for centering the valve spring, the centering elements being disposed radially outwardly of the cylindrical section of the reinforcing ring and being spaced apart along a circumference of the reinforcing ring.

7. The valve shaft seal according to claim 6, wherein the centering elements are formed on an annular member positioned on the cylindrical section of the reinforcing ring.

8. The valve shaft seal according to claim 6, wherein the reinforcing ring is made of metal.

9. The valve shaft seal according to claim 1, wherein the outer diameter of the cylindrical section is provided with a plurality of spaced apart protuberances distributed over a circumference of the cylindrical section.

10. The valve shaft seal according to claim 9, wherein the reinforcing ring is made of metal.

11. The valve shaft seal according to claim 1, including a plurality of centering elements for centering the valve spring, the centering elements being disposed radially outwardly of the cylindrical section of the reinforcing ring and being spaced apart along a circumference of the reinforcing ring.

12. The valve shaft seal according to claim 11, wherein the centering elements are formed on an annular member positioned on the cylindrical section of the reinforcing ring.

13. The valve shaft seal according to claim 11, wherein the reinforcing ring is made of metal.

14. The valve shaft seal according to claim 1, wherein the reinforcing ring is made of metal.

15. A valve shaft seal mounted on a rod and having an axis, the valve shaft seal comprising:

a reinforcing ring comprising a radially outwardly directed end section extending away from the rod, a cylindrical section having an outer surface, and a transition section between the cylindrical section and the radially outwardly directed end section, the transition section having an outer surface;

a sealing element disposed on an end section of the reinforcing ring that is opposite the radially outwardly directed end section, the sealing element contacting the rod;

a valve spring having a planar end supported on the radially outwardly directed end section of the reinforcing ring; and the transition section between the cylindrical section and the radially outwardly directed end section, the transition section being located relative to the cylindrical section such that the outer surface of the transition section is located closer to the axis of the valve shaft seal than the outer surface of the cylindrical section.

16. The valve shaft seal according to claim 15, wherein the transition section of the reinforcing ring possesses a radius.

17. The valve shaft seal according to claim 16, wherein the radius of the transition section has a midpoint located coincident with an outer diameter of the cylindrical section.

18. The valve shaft seal according to claim 15, wherein the outer surface of the cylindrical section is provided with a plurality of spaced apart protuberances distributed over a circumference of the cylindrical section.

19. The valve shaft seal according to claim 15, including an annular member disposed radially outwardly of the cylindrical section, the annular member being provided with a plurality of circumferentially spaced apart protuberances.

* * * * *